US007828508B2

(12) United States Patent
Homma

(10) Patent No.: US 7,828,508 B2
(45) Date of Patent: Nov. 9, 2010

(54) FUEL PUMP

(75) Inventor: Bunji Homma, Ota (JP)

(73) Assignee: Mitsuba Corporation, Kiryu-shi (JP)

( * ) Notice: Subject to any disclaimer, the term of this patent is extended or adjusted under 35 U.S.C. 154(b) by 866 days.

(21) Appl. No.: 11/661,928

(22) PCT Filed: Sep. 6, 2005

(86) PCT No.: PCT/JP2005/016696

§ 371 (c)(1),
(2), (4) Date: Mar. 6, 2007

(87) PCT Pub. No.: WO2006/028243

PCT Pub. Date: Mar. 16, 2006

(65) Prior Publication Data

US 2008/0031733 A1 Feb. 7, 2008

(30) Foreign Application Priority Data

Sep. 8, 2004 (JP) ..... 2004-260689

(51) Int. Cl.
*F04D 1/04* (2006.01)

(52) U.S. Cl. ..... 415/55.1

(58) Field of Classification Search ..... 415/55.1, 415/55.2, 55.3, 55.4, 224; 417/423.3
See application file for complete search history.

(56) References Cited

U.S. PATENT DOCUMENTS 6,796,764 B2 9/2004 Motojima et al.

FOREIGN PATENT DOCUMENTS

| | | | |
|---|---|---|---|
| JP | 63105296 A | * | 5/1988 |
| JP | 11117890 A | * | 4/1999 |
| JP | A 11-117890 | | 4/1999 |
| JP | A 2003-293880 | | 10/2003 |
| JP | A 2004-011556 | | 1/2004 |

OTHER PUBLICATIONS

JP 11117890 A Machine Translation. Accessed Feb. 16, 2010 from http://www4.ipdl.inpit.go.jp/Tokujitu/tjsogodben.ipdl?N0000=115.*

JP 63-105296 A English Translation. The McElroy Translation Co. Feb. 2010. pp. 1-10.*

* cited by examiner

*Primary Examiner*—Richard Edgar
(74) *Attorney, Agent, or Firm*—Oliff & Berridge, PLC

(57) ABSTRACT

A fuel pump includes an outer partitioning wall formed with an intake port; an inner partitioning wall formed with a discharge port; and an impeller housed between the outer partitioning wall and the inner partitioning wall, wherein each of the outer partitioning wall and the inner partitioning wall is formed with a fuel flow path that communicates with the intake port and the discharge port in a portion opposing a blade body provided on a periphery of the impeller, and the intake port is provided with an eddy current prevention section that prevents inflowing fuel from forming an eddy current.

9 Claims, 8 Drawing Sheets

FUEL PUMP

CROSS-REFERENCE TO RELATED APPLICATION

This application is the U.S. National Stage of PCT/JP2005/016696, filed Sep. 6, 2005, which claims priority from JP 2004-260689, filed Sep. 8, 2004, the entire disclosures of which are incorporated by reference thereto.

BACKGROUND

The present invention relates to a fuel pump disposed in a fuel tank of a vehicle.

There exists fuel pumps that are constructed of an outer partitioning wall formed with an intake port, an inner partitioning wall formed with a discharge port and an impeller housed between the opposing partitioning walls.

In such fuel pumps, a circular fuel flow path is formed between the surfaces of the partitioning walls opposing the impeller. The fuel flow path is located in a portion opposing a blade body formed on the periphery of the impeller. The outer partitioning wall is formed with an intake port communicating with the fuel flow path. The inner partitioning wall is formed with a discharge port communicating with the fuel flow path. Thus, the fuel pump is designed as an in-tank type (refer to, for example, Japanese Published Unexamined Patent Application No. 2003-293880).

SUMMARY

In such a conventional fuel pump, the fuel flows along the inside of a cylindrical tube accompanying the rotation of the impeller and enters into the pump from the intake port. Therefore, the fuel flows into the fuel flow path while forming an eddy current whirling along the inner surface of the tube. As a result, a low-pressure portion is formed in an central area of the eddy current and air bubbles are generated. Here, there is a problem in that the flow rate decreases as the temperature of the fuel rises (a reduction in the flow rate due to a high temperature characteristic). In particular, when an outer end and an inner end of the intake port are eccentrically formed, the eddy current is generated more easily. There is a strong demand to eliminate this problem.

Recently, it has been proposed that fuel pumps should be designed smaller in size and lighter in weight. When a fuel pump is applied to a thin tank, the outer partitioning wall is required to be designed thinner. On the other hand, in such a fuel pump, it has been proposed that a portion from the intake port to the fuel flow path should be cut off to form a R-shaped portion (inclined shape or curved shape). That is, the intake portion for the fuel is enlarged to prevent flow rate reduction thereby preventing separation of the current, which causes the pressure reduction. However, when the outer partitioning wall is designed to be thinner, it is difficult to ensure a large radius of curvature in the curved portion (cut-off portion). In such a situation, it is difficult to design a thinner outer partitioning wall. The present invention thus solves the above problems, provides a thinner fuel pump and achieves various other advantages.

The disclosure addresses an exemplary aspect in which a fuel pump includes an outer partitioning wall formed with an intake port; an inner partitioning wall formed with a discharge port; and an impeller housed between the inner partitioning wall and the outer partitioning wall, wherein each of the partitioning walls is formed with a fuel flow path that communicates with the intake port and discharge port in a portion opposing a blade body provided on a periphery of the impeller, and the intake port is provided with an eddy current prevention section that prevents inflowing fuel from forming an eddy current.

By the arrangement as described above, no eddy current is formed in the intake port and not only air bubbles but also suction resistance can be prevented from generating. Accordingly, pressure reduction in a central area of the current due to an eddy current is prevented. Thus, a flow rate reduction due to high-temperature characteristics is prevented.

In another exemplary aspect, the eddy current prevention section is provided at a front side in a rotational direction of the impeller in the intake port. As a result of this arrangement, the generation of an eddy current in the flow of the fuel following the rotation of the impeller is effectively prevented.

In another exemplary aspect, the eddy current prevention section is formed with an eddy current prevention surface orthogonal to a rotational direction of the impeller. As a result of this arrangement, the generation of an eddy current in the flow of the fuel following the rotation of the impeller is effectively prevented.

In another exemplary aspect, an outer end of the intake port is larger in diameter than an inner end of the intake port and the outer end is eccentrically closer to an inner radial side than the inner end. As a result of this arrangement, the fuel pump can be designed to be smaller in size.

In another exemplary aspect, a connection portion from the intake port to the fuel flow path is cut off in an inclined or curved shape. As a result of this arrangement, a large cut-off portion can be ensured in the connection portion without increasing the thickness of the outer partitioning wall, and thus reduction in the flow rate due to separation of the current can be prevented.

In another exemplary aspect, the eddy current prevention section comprises an eddy current prevention surface that is orthogonal to a rotational direction of the impeller and a guide surface in a shape of an arc extending from the eddy current prevention surface to a rear side direction with respect to a rotational direction of the impeller. As a result of this arrangement, the generation of an eddy current is further prevented.

According to various exemplary aspects of the disclosure, no eddy current is formed and generation of air bubbles is prevented. Therefore, generation of suction resistance is prevented. Accordingly, a pressure reduction of the current, which occurs in a central area thereof due to an eddy current, is prevented. Thus, a flow rate reduction due to high-temperature characteristics is prevented.

According to various exemplary aspects of the disclosure, the generation of an eddy current in the fuel flow, which follows the rotation of the impeller, is effectively prevented.

According to various exemplary aspects of the disclosure, the generation of an eddy current in the fuel flow, which follows the rotation of the impeller, is effectively prevented.

According to various exemplary aspects of the disclosure, the fuel pump can be designed to be smaller in size.

According to various exemplary aspects of the disclosure, a large cut-off portion can be ensured in the connection portion without increasing the thickness of the outer partitioning wall, and thus a flow rate reduction due to separation of the current can be prevented.

According to various exemplary aspects of the disclosure, the generation of eddy current is further prevented.

BRIEF DESCRIPTION OF THE DRAWINGS

Various embodiments of the invention will be described with reference to the drawings, wherein.

DETAILED DESCRIPTION OF EMBODIMENTS

Figure 1:
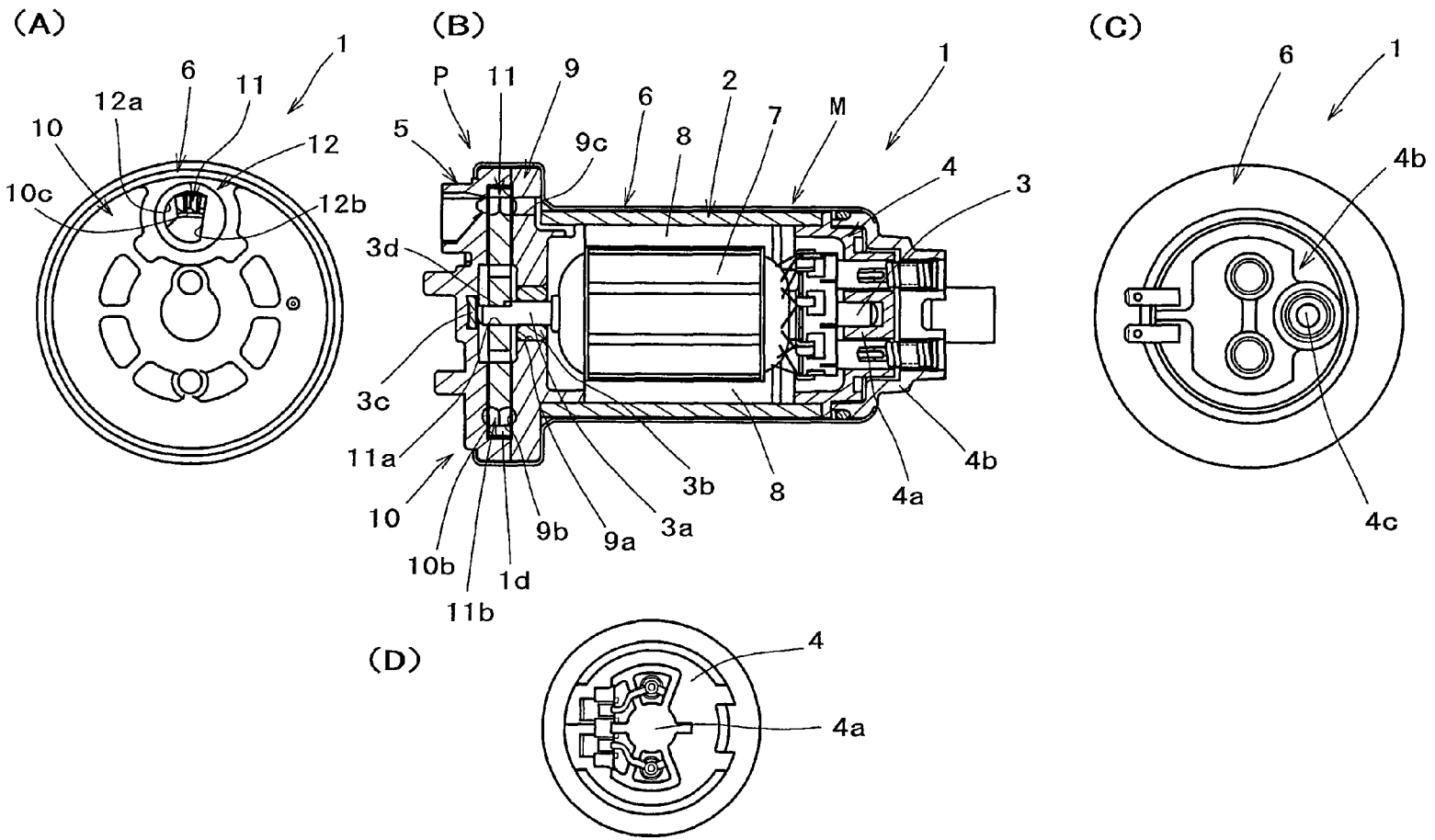
FIG. 1A is a side view of a fuel pump.
FIG. 1B is a front view of the fuel pump.
FIG. 1C is a side view of the fuel pump.
FIG. 1D is a side view of the fuel pump from which an end cover is removed.
Figure 2:
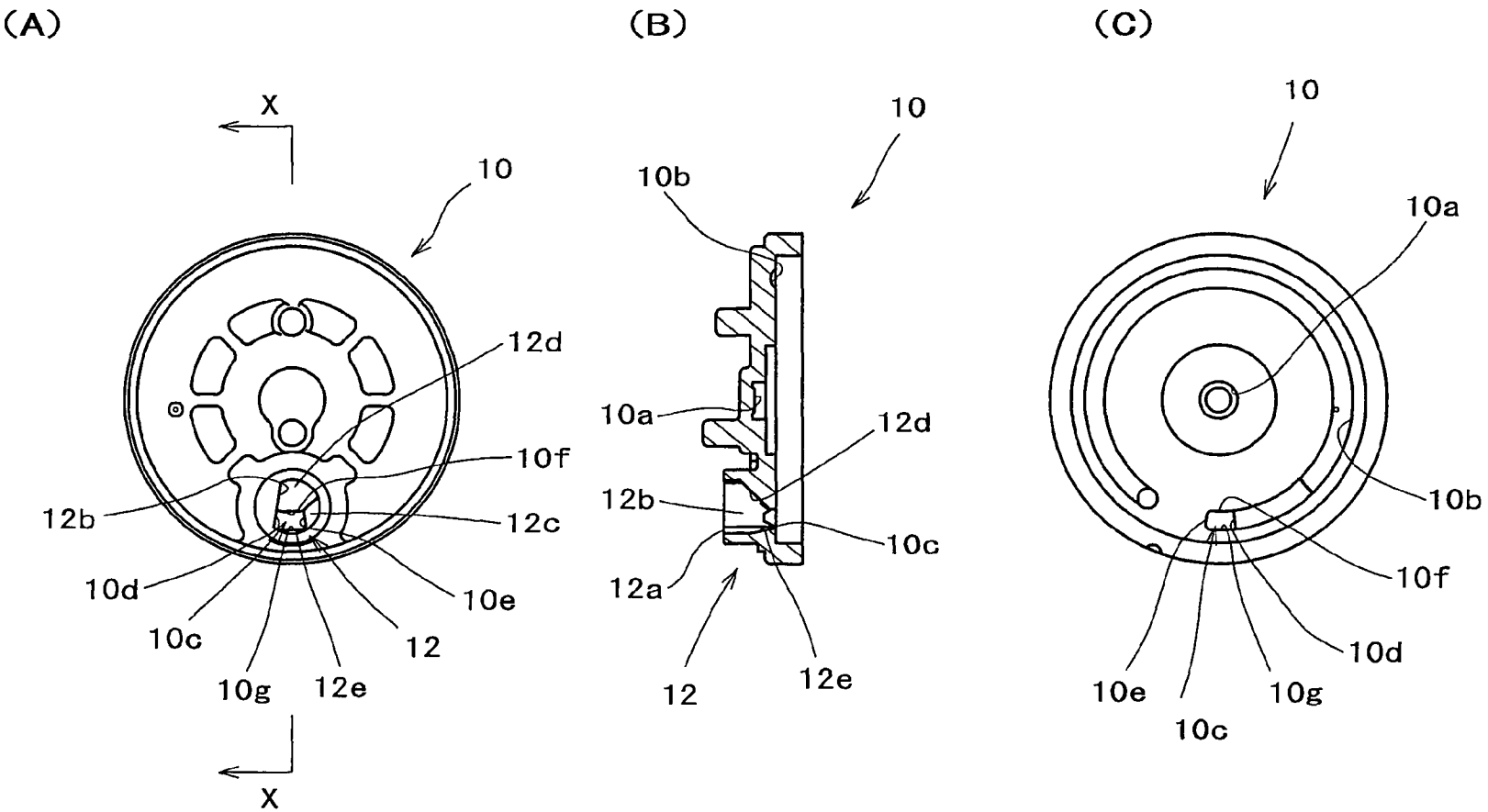
FIG. 2A is a side view of a second plate.
FIG. 2B is a cross-sectional view taken along the line X-X in FIG. 2A.
FIG. 2C is a side view of the second plate.
Figure 3:
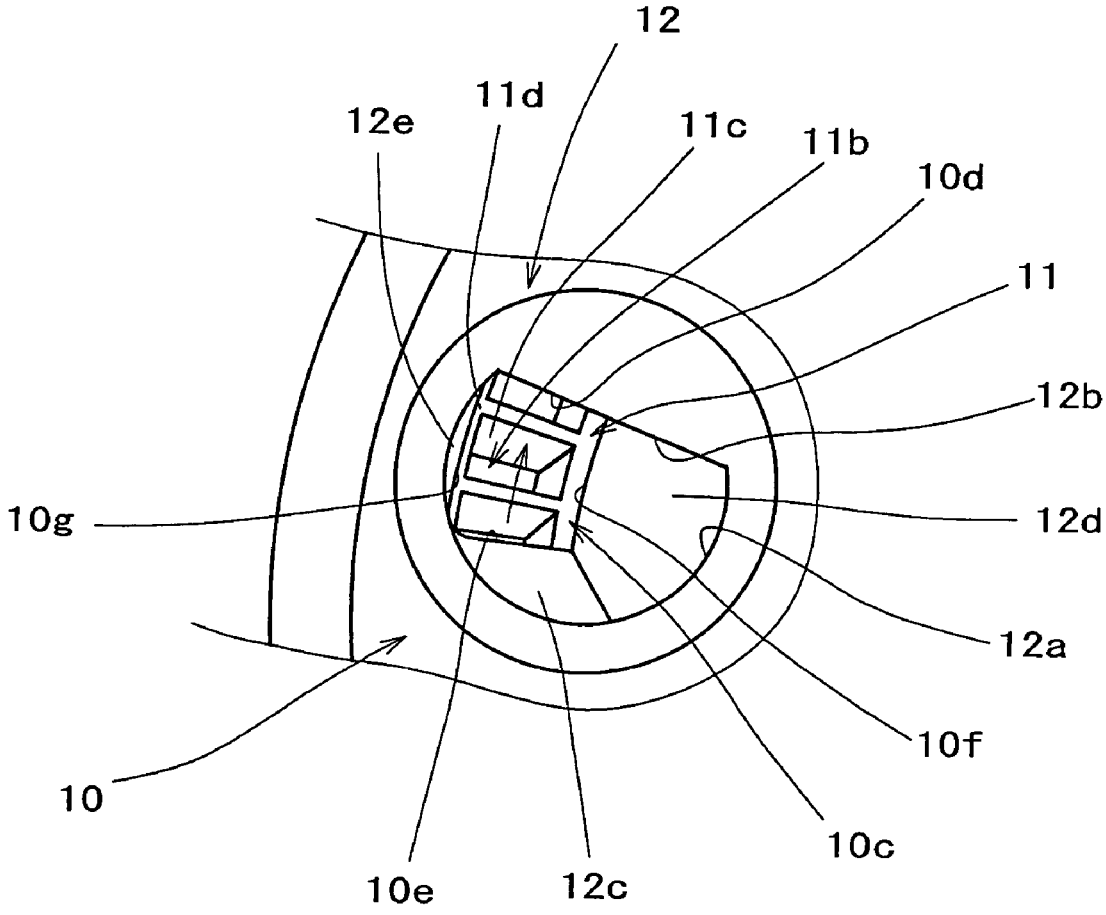
FIG. 3 is an enlarged perspective view of the pump section.
Figure 4:
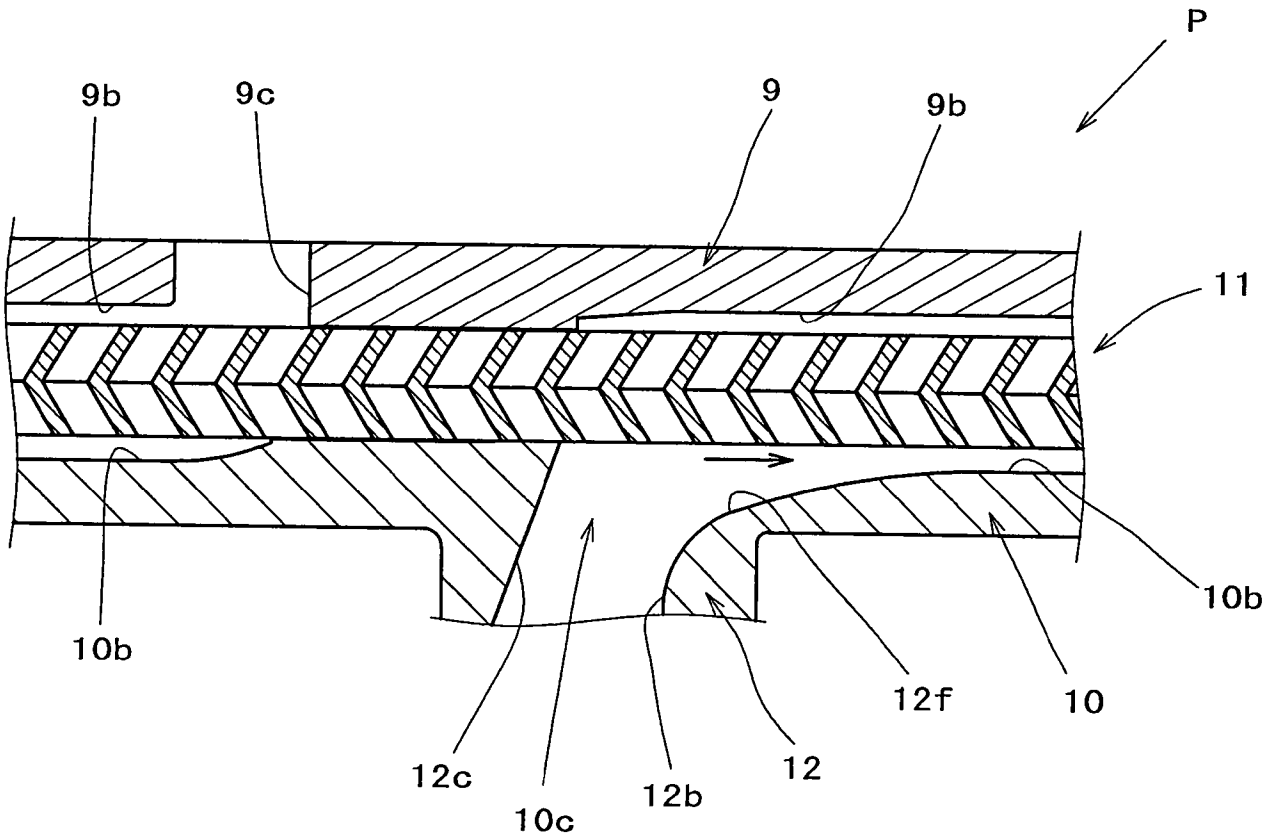
FIG. 4 is an enlarged cross-sectional view of the pump section.

Now, a first embodiment of the present invention will be described with reference to FIGS. 1A through 4.

In the figures, reference numeral 1 denotes a fuel pump, which is disposed within a fuel tank. The fuel pump 1 includes a motor section M located at one end of a cylindrical casing 2 and a pump section P located at the other end thereof. A bracket 4 supports a motor shaft 3 in a rotatable manner via a bearing 4*a* that is disposed such that the bearing 4*a* covers a cylinder end located at one end of the casing 2. On the other hand, the other end 3*a* of the motor shaft 3 is rotatably supported by a pump casing 5, which is disposed so as to cover a cylinder end on the outer side of the casing 2 constituting the pump section P of the present invention.

Reference numeral 6 denotes a cover, which covers the periphery of a casing 2, the bracket 4 and the pump casing 5. The cover 6 is integrally caulked and fitted with the periphery of the casing 2, the bracket 4 and the pump casing 5. Reference numeral 7 denotes an armature core integrally engaged with the periphery of the motor shaft 3. Reference numeral 8 denotes permanent magnets attached to the inner face of the casing 2. Reference symbol 4*b* denotes an end cover disposed to cover the bracket 4.

The pump casing 5 is constructed of a first plate 9 as an inner partitioning wall according to the present invention and a second plate 10 as an outer partitioning wall according to the present invention. The first plate 9 and the second plate 10 are formed in a disk-like shape, respectively, and are disposed parallel to each other in an axial direction of the motor shaft 3. The other end 3*a* of the motor shaft 3 extends via a bearing 3*b*, which is disposed in a through hole 9*a* of the first plate 9 located at the inner side, and rotatably supported by the bearing 3*b*. The thrust end of the motor shaft 3 is supported by a bearing 3*c* located in a concave portion 10*a* of the second plate 10, which is located at the outside. As a result of this arrangement, the motor shaft 3 is prevented from moving in the axial direction of the pump casing 5 as described above, and supported in a rotatable state.

The impeller 11 is received in a space formed between the first and second plates 9, 10. The impeller 11 is formed with a through hole 11*a* for externally engaging with the motor shaft 3 in the central area of a disk-like plate member (disk member) having a predetermined thickness. On the other hand, the other end 3*a* of the motor shaft is formed with a bearing chamfer 3*d*. When the impeller 11 is attached to the periphery of the other end 3*a* of the motor shaft 3, the impeller 11 is externally attached to the motor shaft 3 so as to rotate integrally with the motor shaft 3.

On the outer periphery of the impeller 11, a plurality of through holes 11*b* are formed parallel to each other in the circumferential direction so that the through holes 11*b* are opened through the plate in a thickness direction of the impeller 11. As a result of this, each blade body 11*c* is formed between the neighboring through holes 11*b* on the outer periphery of the impeller 11 so that a plurality of the blade bodies 11*c* are parallel to each other in the circumferential direction. Furthermore, a ring-like portion 11*d* is integrally formed at the outer side of the blade bodies 11*c* in the circumferential direction.

On the other hand, on the surface of the first plate 9 as the inner partitioning wall, at a side where the impeller 11 is installed (outer side, and on the other end side) and at the location of the portion opposing the impeller blade bodies 11*c*, an inner ring-like groove 9*b* is formed to be concaved at the one end side. Also, on the surface in the one end of the second plate 10 as the outer partitioning wall, and at the outer radial side of the portion where the concave portion 10*a* is formed (i.e., at the location of a portion opposite the impeller blade bodies 11*c*), an outer ring-like groove 10*b* is formed to be concaved at the other end side. When the impeller 11 is activated and the blade bodies 11*c* formed on the impeller 11 are rotated, the inner ring-like groove 9*b* and the outer ring-like groove 10*b* form a fuel flow path in combination with the through holes 11*b* formed on the impeller.

At the outer radial side of the first plate 9, a discharge port 9*c* communicating with the inner ring-like groove 9*b* is opened orienting in the axial direction so as to communicate with the motor section M (inside of the casing 2).

Further, at the outer radial side of the second plate 10, an intake port 12 communicating with the outer ring-like groove 10*b* is formed. The present invention is implemented in the intake port 12.

That is, the intake port 12 is formed to be a tubular-shaped member protruding outward from the outer side face of the second plate 10. The intake port 12 is provided with an inner end 10*c* facing the impeller 11 and an outer end 12*a* facing the outside and is formed integrally with the second plate 10. The outer end 12*a* of the intake port 12 is formed to be larger in diameter than the inner end 10*c*, and is located eccentrically closer to the inner radial side than the inner end 10*c*. The opening of the inner end 10*c* is formed in a substantially rectangular shape being enclosed by four edges; i.e., a front-side edge 10*d* located at the front side with respect to the rotational direction of the impeller 11, a rear-side edge 10*e* located at the rear side, an inner radial side edge 10*f* located at inner radial side with respect to the center of the disk of the second plate 10 and an outer radial side edge 10*g* located at the outer radial side thereof.

On the inner peripheral face from the outer end 12*a* to the inner end 10*c* of the tubular-shaped intake port 12, a portion that is located at the front side of the rotational direction of the impeller 11 is formed thicker than another portion and protrudes toward the inner radial side. As a result of this arrangement, an eddy current prevention surface (eddy current prevention section) 12*b*, which is orthogonal to the rotational direction of the impeller 11, is formed. The eddy current prevention surface 12*b* is formed continuously with the front-side edge 10*d* of the inner end 10*c* in an orthogonal state to the surface of the second plate 10. As a result of this arrangement, the fuel flowing in from the outer end 12*a* of the intake port 12 impinges against the eddy current prevention surface 12*b* and is prevented from forming an eddy current, thus an eddy current is prevented from being formed inside the tube of the intake port 12. Moreover, on the inner peripheral surface of the intake port 12 from the outer end 12*a* to the inner end 10*c*, sloped surfaces 12*c*, 12*d* and 12*e* are formed respectively between the outer end 12*a* and the rear-side edge 10*e*, the inner-radial side edge 10*f* and the outer-radial side edge 10*g*.

Moreover, the front-side edge 10*d* of the inner end continuous with the eddy current prevention surface 12*b* and the outer ring-like groove 10*b* as the fuel flow path are connected substantially orthogonal to each other. This portion is cut off into a curved shape to be a curved portion 12*f*. Here it should be noted that in the eddy current prevention surface 12*b*, the tubular portion, which constitutes the intake port 12, is provided with the portion that is located at the front side of the rotational direction of the impeller 11 and is formed thicker than another portion. Thereby, a large curvature is ensured for the curved portion 12*f*, which is formed by chamfering a portion between the eddy current prevention surface 12*b* and the ring-like groove 10*b*. As a result of this arrangement, a large space (fuel intake portion) is formed in the portion from the intake port 12 to the ring-like groove 10*b* thereby ensuring a large flow rate. Moreover, the fuel is prevented from being separated at the connected portion between the eddy current prevention surface 12*b* and the ring-like groove 10*b* when the fuel flows into a pump chamber, and thus no pressure reduction occurs.

In the intake port 12 arranged as described above, when the impeller 11 is driven to rotate in a direction indicated by the arrowhead via the motor shaft 3, the fuel contained within the fuel tank flows into the pump chamber from the outer end 12*a* of the intake port 12 through the inner end 10*c*. The fuel reaches to a predetermined pressure while being transferred within the ring-like grooves 10*b* and 9*b* and is discharged to the motor section M from the discharge port 9*c*. Then the fuel is spouted from an spout port 4*c* formed in the bracket 4. When the impeller 11 rotates in a direction indicated with an arrowhead shown in FIG. 3 and the pump operation is performed by the blade body 11*c*, the fuel flows into the pump chamber from the outer end 12*a*, which has a larger diameter, through the inner end 10*c*, which has a smaller diameter than the intake port 12. At this time, when the fuel flows toward the inner end 10*c* along the inner tubular wall of the intake port 12, the fuel will form an eddy current in the same direction as the rotational direction of the impeller 11. However, there is formed the eddy current prevention surface 12*b* on the inner wall of the tubular intake port 12, which is located at the front side in the rotational direction of the impeller 11 and orthogonal to the rotational direction of the impeller 11. Therefore, the fuel, which is forced to whirl in the clockwise direction, impinges against (abut on) the eddy current prevention surface 12*b* thereby being compelled to change its flowing direction. As a result of this, the fuel is prevented from forming an eddy current and accordingly air bubbles are prevented from being generated.

Figure 5:
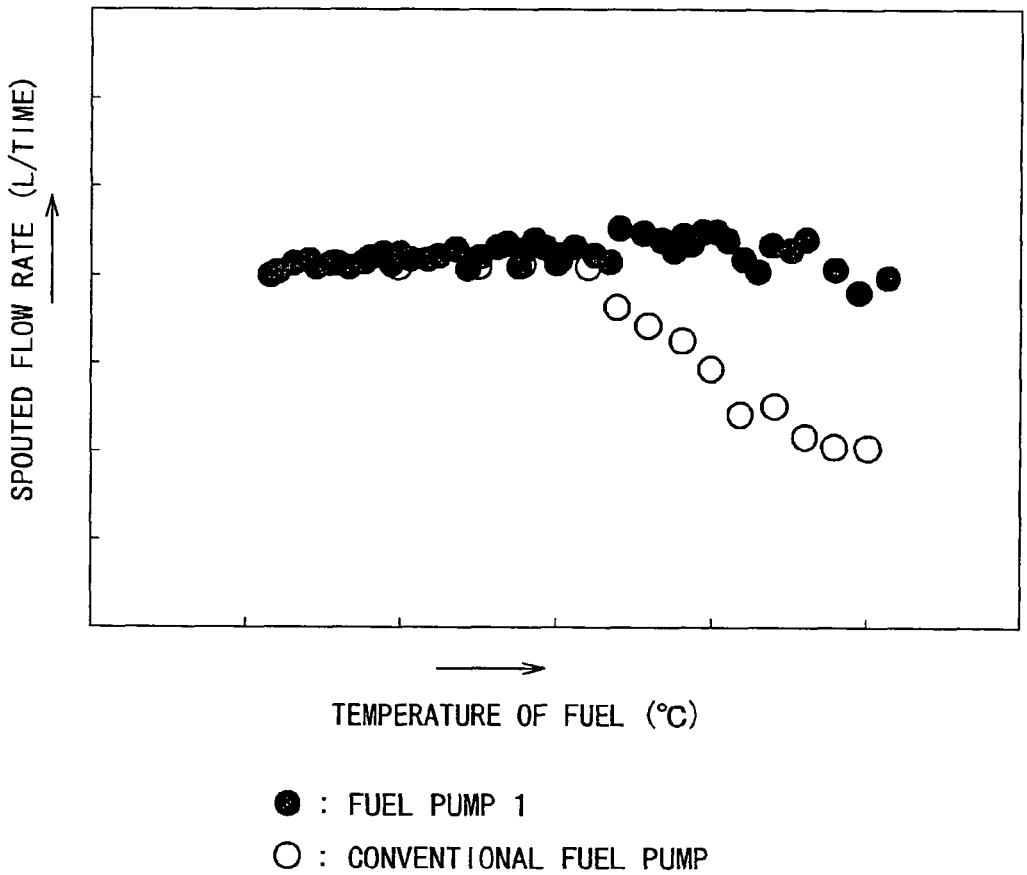
FIG. 5 is a diagram showing changes in spouted flow rates with respect to temperature change in the fuel pump according to the embodiment and a conventional fuel pump.

FIG. 5 is a diagram showing a measurement result of changes in the spouted flow rate of the fuel versus temperature changes using the fuel pump 1 of the embodiment and a conventional fuel pump, which is provided with a fuel guide path without the eddy current prevention surface 12*b*. Referring to FIG. 5, compared to the conventional fuel pump in which the spouted flow rate decreases as the temperature of the fuel increases, in the fuel pump 1 of the embodiment, the spouted flow rate does not decrease even when the temperature increases. It is thus demonstrated that the eddy current prevention surface 12*b* formed in the intake port 12 is effective.

In the embodiment constituted as described above, when the impeller 11 is driven to rotate by the motor section M, the pump starts its operation as described above, and the fuel flows into the pump chamber from the outer end 12*a* through the inner end 10*c* of the intake port 12. At this time, when the fuel flows into the pump chamber along the inner wall of the tube of the intake port 12, the flow of the fuel is forced to form an eddy current along the rotational direction of the impeller 11. However, the flow of the fuel abuts against the eddy current prevention surface 12*b* formed on the inner wall of the tube of the intake port 12 and is prevented from forming the eddy current. Therefore, the pressure adjacent to the intake port 10*c* is prevented from being reduced, and thus the generation of air bubbles is prevented. Further, the generation of suction resistance is prevented, and local pressure reduction that tends to be generated in the central area of an eddy current is also prevented. Thus, performance reduction of the fuel pump due to the flow rate reduction can be prevented.

Also, in this embodiment, the eddy current prevention surface 12*b* is formed in the intake port 12 being located at the front side of the impeller 11 in the rotational direction thereof. Therefore, an eddy current of the fuel, which tends to be formed when the fuel flows into the intake port 12 following the rotation of the impeller 11, can be prevented effectively.

Further, in this embodiment, the eddy current prevention surface 12*b* has a plane orthogonal to the rotational direction of the impeller. The plane, which is positioned orthogonal to the flow of the fuel flowing into the intake port 12, forcibly changes the flowing direction of the fuel thereby effectively preventing the generation of an eddy current.

Furthermore, in this embodiment, the outer end 12*a* of the intake port 12 is formed larger in diameter than the inner end 10*c*, and is positioned eccentrically closer to the inner radial side. Therefore, the diameter of the pump section P can be reduced and a margin for caulking is ensured for the cover 6 which is integrally caulked together with the pump section P and the motor section M. In such a case, since the outer end 12*a* is formed eccentrically with respect to the inner end 10*c*, the eddy current tends to be generated more easily. However, in this embodiment, since the eddy current prevention surface 12*b* is formed, the generation of an eddy current is prevented. Thus, a compact fuel pump that can prevent the eddy current is achieved.

Still further, in this embodiment, a portion of the intake port 12 is formed thicker than another area to form the eddy current prevention surface 12*b*. Therefore, a large radius of curvature can be ensured for the curved portion without increasing the thickness of the second plate 10 in order to form the portion from the eddy current prevention surface 12*b* to the outer ring-like groove 10*b* in an R-shape. A large area can be formed for the fuel intake portion from the intake port 12 to the pump chamber, and thus separation of the fuel flow is prevented. Thus, the flow rate reduction due to the high-temperature characteristics can be suppressed more effectively and a superior fuel pump can be achieved.

Figure 6:
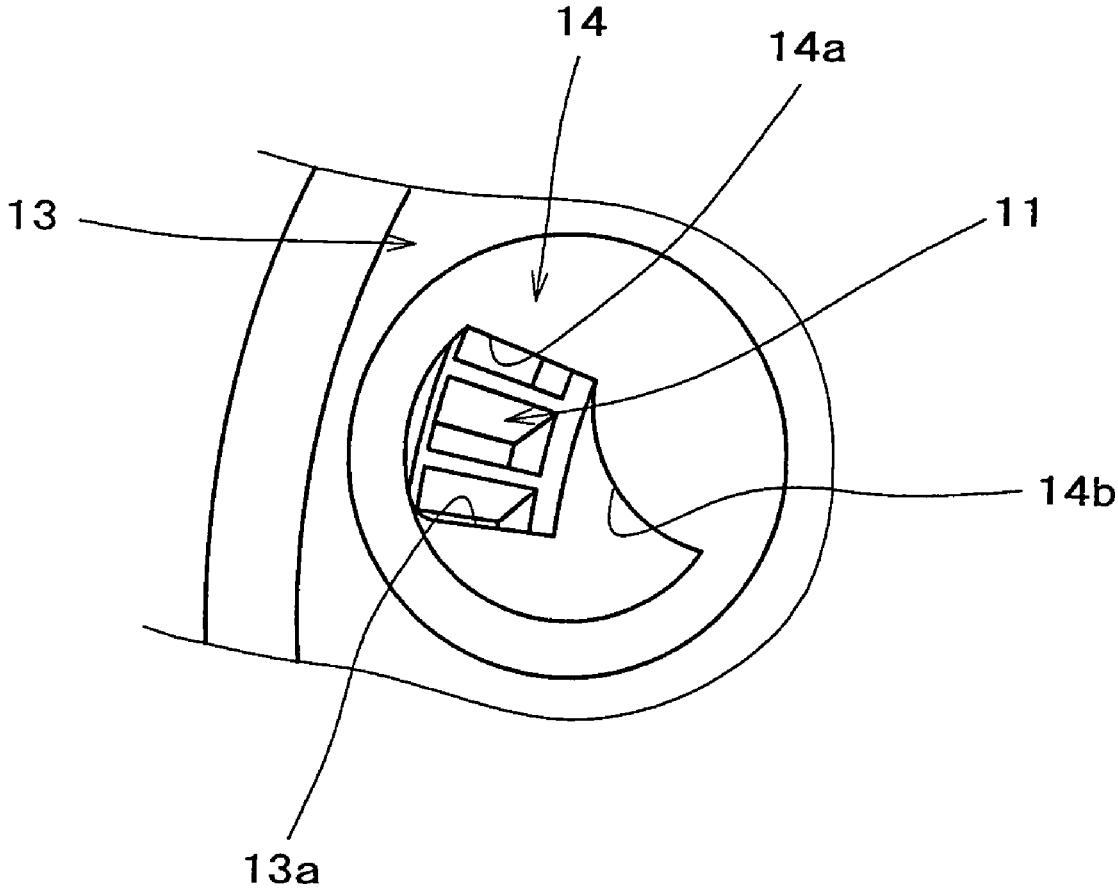
FIG. 6 is an enlarged perspective view of the pump section of a second embodiment.
Figure 7:
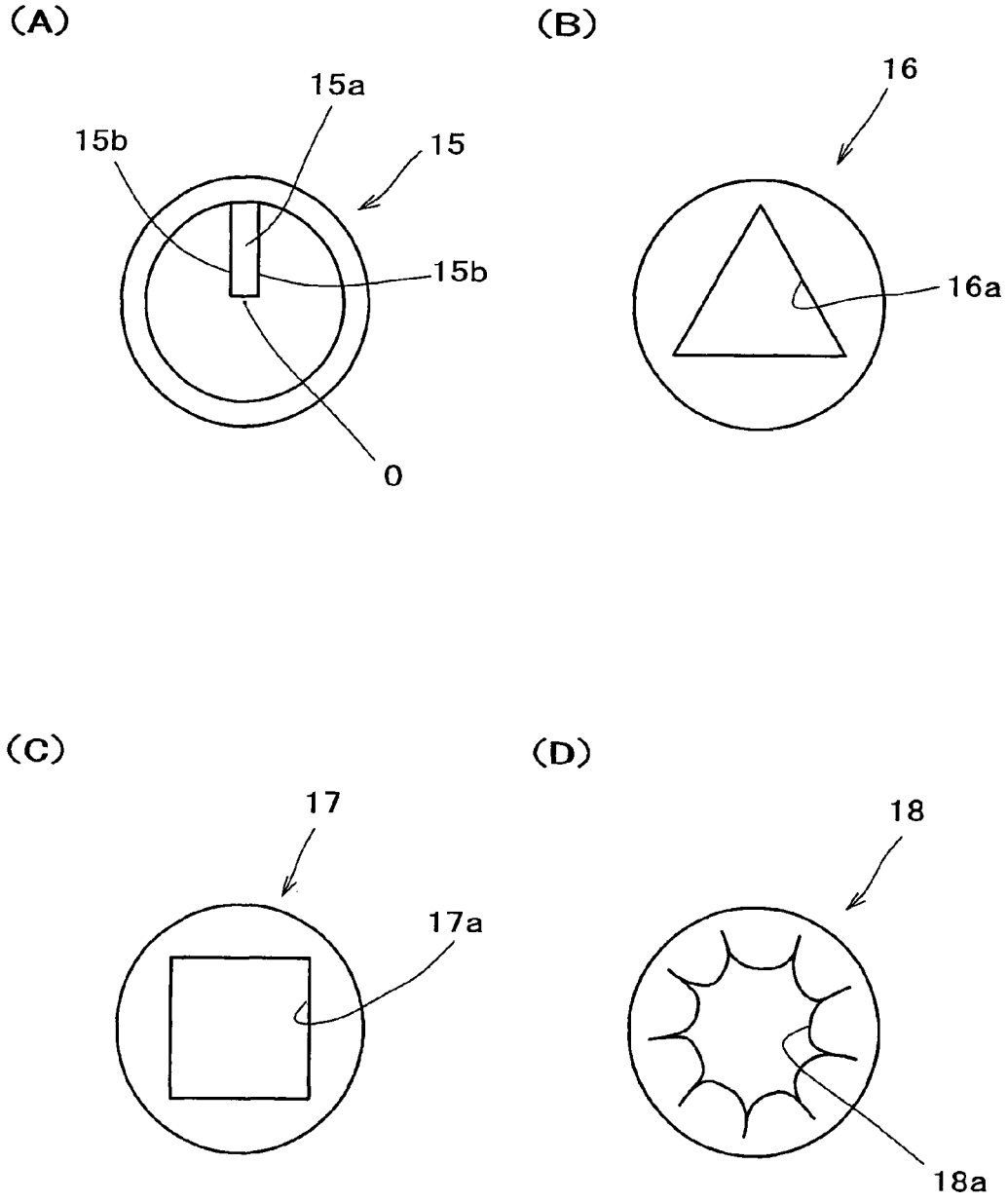
FIG. 7A is a diagram of a pattern in a third embodiment.
FIG. 7B is a diagram of a pattern in a fourth embodiment.
FIG. 7C is a diagram of a pattern in a fifth embodiment.
FIG. 7D is a diagram of a pattern in a sixth embodiment.

As a matter of course, the present invention is not limited to the above-described first embodiment but the present invention is applicable to a second embodiment shown in FIG. 6.

In the second embodiment, a fuel guide path 14 is formed continuous with an intake port 13*a* of a second plate 13 (outer partitioning wall). The fuel guide path 14 includes an eddy current prevention surface 14*a*, which is formed orthogonal to the rotational direction of the impeller 11, and a guide surface 14*b* having an arc-like shape, which extends from the eddy current prevention surface 14*a* to the rear side direction with respect to a rotational direction of the impeller 11. As a result of this arrangement, the fuel entering into the fuel guide path 14 flows toward the eddy current prevention surface 14*a* along the guide surface 14*b*. Thus, the generation of an eddy current in the fuel is further prevented, and accordingly generation of air bubbles is reduced and the flow rate reduction due to the high-temperature characteristics can be suppressed.

Further, in the above-described embodiments, the inner end and the outer end of the intake port 13*a* are formed eccentrically with respect to each other. The intake port 13*a* also, in which the center of the opening of the inner end (center in the radial direction of the blade body on the impeller) substantially coincides with the center of the tubular outer end, forms the eddy current prevention section. Therefore, the eddy current of the fuel, which whirls along the inner wall surface of the cylindrical intake port 13*a* is prevented, and thus the reduction of the flow rate due to the high-temperature characteristics can be suppressed.

Furthermore, the present invention may be applied to the third to sixth embodiments shown in FIGS. 7A to 7D.

In the third embodiment, a plate-like member 15*a*, which extends from the center O of a tubular intake port 15 at the front side of the impeller 11 in the rotational direction thereof, is provided thereby forming an eddy current prevention surface 15*b* orthogonal to the flow of the eddy current. Thus, the generation of the eddy current can be reduced. In the fourth and fifth embodiments, the intake ports 16 and 17 have a circular external shape. However, the inner cylindrical portion has a triangle shape, the apex of which is positioned at the front side of the impeller 11 in the rotational direction thereof. Or, the inner cylindrical portion has a rectangular shape, one edge of which is positioned at the front side of the impeller in the rotational direction thereof. In these embodiments also, an eddy current prevention section is formed by forming an angular shape in cylindrical inner walls 16*a* and 17*a*, respectively, thereby reducing the generation of the eddy current. Further, in a sixth embodiment, a cylindrical inner wall 18*a* of an intake port 18 is formed with an eddy current prevention section by forming a plurality of curved surfaces extending toward the center of the intake port 18*a*. By arranging the inner wall as described above, the eddy current can be reduced.

Figure 8:
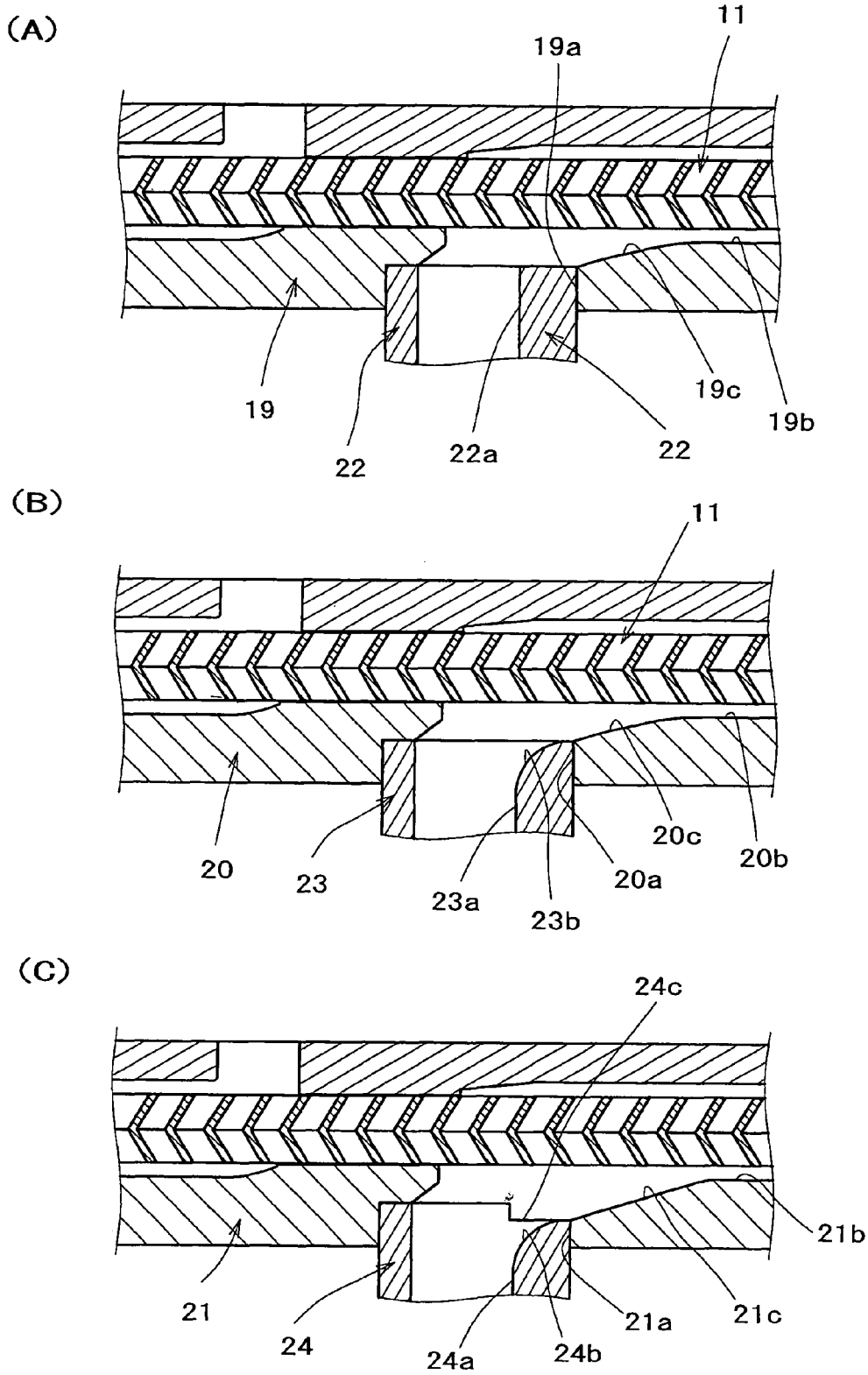
FIG. 8A is an enlarged cross-sectional view of the pump section in a seventh embodiment.
FIG. 8B is an enlarged cross-sectional view of the pump section in an eighth embodiment.
FIG. 8C is an enlarged cross-sectional view of the pump section in a ninth embodiment.

Further, a seventh embodiment shown in FIG. 8A, an eighth embodiment shown in FIG. 8B and a ninth embodiment shown in FIG. 8C may be employed. These embodiments are arranged so that, outer partitioning walls 19, 20, and 21 are formed with a through holes 19*a*, 20*a*, and 21*a*, respectively, which are opened therethrough in a thickness direction thereof. The through holes 19*a*, 20*a*, and 21*a* are integrally connected with cylindrical intake ports 22, 23, and 24, respectively, which are formed separately from the outer partitioning walls 19, 20, and 21 by coupling its base portion with the edge of the through holes 19*a*, 20*a*, and 21*a*. In these embodiments also, eddy current prevention surfaces 22*a*, 23*a*, and 24*a*, which are orthogonal to the rotational direction of the impeller 11, are formed on the inner wall in a portion at the front side of the impeller 11 in the rotational direction thereof in the intake ports 22, 23, and 24. Thus, generation of an eddy current in the fluid is prevented and the reduction of the flow rate due to high-temperature characteristics is suppressed.

Further, in the seventh embodiment, in a portion from the intake port 22 (eddy current prevention surface 22*a*) to a fuel flow path 19*b* of the outer partitioning wall 19, the fuel flow path 19*b* is cut off to form an inclined surface 19*c* thereby preventing the flow rate reduction due to separation of the current. In the eighth and ninth embodiments, in a portion from the eddy current prevention surfaces 23*a* and 24*a* to fuel flow paths 20*b* and 21*b* of the outer partitioning walls 20 and 21, the eddy current prevention surfaces 23*a* and 24*a* are cut off to form curved portions 23*b* and 24*b* and the fuel flow paths 20*b* and 21*b* are cut off to form inclined surfaces 20*c* and 21*c*. Thus, the flow rate reduction due to separation of the current is prevented. In the ninth embodiment, a step portion 24*c* is formed in the intake port 24 to shorten the length thereof in the longitudinal direction of the tube at the side of the fuel flow path 21*b*. Thus, a large inclined surface 21*c* is ensured at the side of the fuel flow path 21*b*. As a result of this arrangement, a large capacity is ensured in a portion from the eddy current prevention surface 24*a* to the fuel flow path 21*b* thereby preventing the flow rate reduction.

As described above, the fuel pump according to the present invention is useful as a fuel pump or the like disposed within a fuel tank or the like of a vehicle, particularly, in a fuel pump in which the outer end and the inner end of the intake port are eccentrically formed in which an eddy current tends to be easily generated. The fuel pump according to the present invention is applicable to a fuel pump to be designed small in size and light in weight.

The invention claimed is:

1. A fuel pump, comprising:

an outer partitioning wall formed with a tubular-shaped intake port;

an inner partitioning wall formed with a discharge port; and an impeller housed between the outer partitioning wall and the inner partitioning wall, wherein each of the outer partitioning wall and the inner partitioning wall is formed with a fuel flow path that communicates with the intake port and the discharge port in a portion opposing a blade body provided on a periphery of the impeller, and a surface of inner peripheral surfaces of the intake port at a front side in a rotational direction of the impeller is formed to be orthogonal to the rotational direction of the impeller, the surface functioning as an eddy current prevention section that prevents eddy currents such that inflowing fuel from the intake port is prevented from forming an eddy current into the fuel flow path.

2. The fuel pump according to claim 1, wherein an outer end of the intake port is larger in diameter than an inner end of the intake port and the outer end is eccentrically closer to an inner radial side than the inner end.

3. The fuel pump according to claim 2, wherein a connection portion from the intake port to the fuel flow path is cut off in an inclined or curved shape.

4. The fuel pump according to claim 2, wherein the eddy current prevention section comprises a guide surface in a shape of an arc extending from the surface to a rear side direction with respect to the rotational direction of the impeller.

5. The fuel pump according to claim 1, wherein a connection portion from the intake port to the fuel flow path is cut off in an inclined or curved shape.

6. The fuel pump according to claim 5, wherein the eddy current prevention section comprises a guide surface in a shape of an arc extending from the surface to a rear side direction with respect to the rotational direction of the impeller.

7. The fuel pump according to claim 1, wherein the eddy current prevention section comprises a guide surface in a shape of an arc extending from the surface to a rear side direction with respect to the rotational direction of the impeller.

8. The fuel pump according to claim 1, wherein an opening of an inner end of the intake port is formed in a substantially rectangular shape.

9. The fuel pump according to claim 1, wherein the outer partitioning wall is formed with a through hole and the through hole is integrally connected with the intake port that is formed separately from the outer partitioning wall, by coupling a base portion of the intake port with an edge of the through hole.

* * * * *